US007339456B1

(12) United States Patent
Buckley et al.

(10) Patent No.: US 7,339,456 B1
(45) Date of Patent: Mar. 4, 2008

(54) ELECTROMECHANICAL SAFETY SYSTEM FOR A FIREARM

(76) Inventors: Jonathan D. Buckley, 9240 Hickory Hill Rd., Lexington, KY (US) 40515; Tony A. Hancock, 1783 Ironworks Pike, Lexington, KY (US) 40511; Austin D. Pyle, 4791 Bryan Station Rd., Lexington, KY (US) 40516

( * ) Notice: Subject to any disclaimer, the term of this patent is extended or adjusted under 35 U.S.C. 154(b) by 906 days.

(21) Appl. No.: 09/270,461

(22) Filed: Mar. 15, 1999

(51) Int. Cl.

| | |
|---|---|
| ***G05B 19/00*** | (2006.01) |
| ***G06F 7/00*** | (2006.01) |
| ***G06K 19/00*** | (2006.01) |
| ***G08B 29/00*** | (2006.01) |
| ***H04B 1/00*** | (2006.01) |

(52) U.S. Cl. ..... 340/5.51; 42/84; 42/70.11

(58) Field of Classification Search ..... 340/5.51; 42/84, 70.11, 70.06, 70.07

See application file for complete search history.

(56) References Cited

U.S. PATENT DOCUMENTS 5,016,376 A * 5/1991 Pugh ..... 42/70.11
5,062,232 A * 11/1991 Eppler ..... 42/70.11
5,704,151 A * 1/1998 West et al. ..... 42/70.07
5,812,252 A * 9/1998 Bowker et al. ..... 356/71
6,237,271 B1 * 5/2001 Kaminski ..... 42/70.06
6,293,039 B1 * 9/2001 Fuchs ..... 42/70.11

* cited by examiner

*Primary Examiner*—Brian Zimmerman
*Assistant Examiner*—Nam Nguyen
(74) *Attorney, Agent, or Firm*—Finnegan, Henderson, Farabow, Garrett & Dunner, L.L.P.

(57) ABSTRACT

An electromechanical locking apparatus, which is integral with a firearm, selectively disables the firearm. The electromechanical locking apparatus comprises an electrically driven input device personalized to an authorized user such as a keypad. The electrically driven input device connects a battery to a motor, which rotates a gear train. The gear train drives a pin into one of two notches or apertures in a trigger of the firearm so as to prevent rotation of the trigger whereby the firearm is rendered inoperable irrespective of whether the trigger is in its cocked or uncocked position.

5 Claims, 4 Drawing Sheets

ELECTROMECHANICAL SAFETY SYSTEM FOR A FIREARM

CROSS REFERENCE TO RELATED APPLICATION

Not Applicable

STATEMENT RE: FEDERALLY SPONSORED RESEARCH OR DEVELOPMENT

Not Applicable

REFERENCE TO MICROFICHE APPENDIX

Not Applicable

BACKGROUND

1. Field of the Invention

This invention relates to a safety system for a firearm, and more particularly to an electromechanical safety system accessible to an authorized user only.

2. Description of the Related Art

With 16 children on average being killed in the United States every day by a firearm, there is an obvious and compelling need to make firearms operable by only those individuals authorized to use them.

External trigger locks fitting around the trigger and preventing the use of the firearm have long been offered as one solution. That approach has proven to be ineffective for several reasons:

- the trigger locks have trouble fitting effectively around the myriad of trigger guards;
- not all firearms have trigger guards;
- trigger locks cannot be used to lock a loaded firearm;
- those that use a key generally end up being stored with the key hidden nearby;
- many can be easily disabled with common hand tools; and
- the average firearm owner does not think he can find the key or remember the combination, unlock the trigger guard, and load the weapon in the dark in a short enough time to defend himself from an intruder.

Others have approached the problem by:

using radio signals to energize a solenoid to block the trigger (U.S. Pat. No. 5,168,114 issued to Enger on Dec. 1, 1992); or using the interaction with a passive electronic circuit worn on the body of an individual to energize a motor or solenoid within the firearm by either having that electronic circuit detected by an electronic energy field in the firearm, or by generating an authorizing signal or code in short wave. (U.S. Pat. No. 4,488,370 issued to Lemelson on Dec. 18, 1984); or using a magnetized ring or microchip bearing ring coming within the range of a decoder on the firearm which generates an electronic signal to energize a solenoid to activate or deactivate the firearm. (U.S. Pat. No. 5,016,376 issued to Pugh on May 21, 1991); or using a code generator such as a microchip or bar code, worn on the finger or the palm of the hand which is read by a detector in the handgun, which in turn will actuate or deactuate a solenoid. (U.S. Pat. No. 5,062,232 issued to Eppler on Nov. 5, 1991); or using an external keypad as an electronic key by connecting it to an electronic decoder unit on the handle of the firearm which then energizes a motor to rotate an aperture in a gear which will either allow the main spring rod of the firearm to be moved to a position to be actuable by the trigger, or will prevent it from so doing. The main spring rod is connected to the hammer and controls the release of the hammer to strike the cartridge. (U.S. Pat. No. 5,022,175 issued to Oncke on Jun. 11, 1991); or using an audio receiver on the firearm to recognize and respond to audio frequency signals such as a word or words authorizing an element to block the backward movement of the trigger. (U.S. Pat. No. 5,546,690 issued to Ciluffo on Aug. 20, 1996).

With the exception of the aforesaid Ciluffo patent, all of the above approaches require the use of an identifying and/or authorizing device external to the firearm. As a practical matter, while a police officer may on a daily basis, carry or wear as part of his equipment, a key, magnet, radio transmitter, specialized electronic circuit, or some such other device, the average firearm owner will not. Accordingly, safety systems relying on such an approach will not likely be in demand and will not be commercially feasible.

The efficacy of a voice recognition approach, as suggested by the aforesaid Ciluffo patent, is limited by the ability of voice recognition devices to reliably distinguish one particular voice from another, as well as by the large amount of electric power necessary to operate a voice recognition system of that sort with any kind of consistency.

Additionally, since firearms in general, and handguns in particular, are significantly lacking in available space for any additional modifications, any safety system that relies in part on the use of a solenoid is not likely to be commercially feasible due to the necessarily large size of a solenoid, as well as the attendant huge demand for power to drive a solenoid. Solenoids require a substantial surge of power for initial activation, as well as the constant application of power to remain activated. Battery operated solenoids will run the risk of total or partial failure. An electronic safety system that does not work on demand or runs the risk of limited success will not be marketable. In the world of firearms, the system cannot work just "most of the time"; it must work every time.

Lastly, while it may seem attractive to place things in the grip of a firearm, as suggested by much of the prior art, generally speaking, the grip cannot be expanded much, if at all, without making it too large for an individual to hold and still reach the trigger with the first joint of the index finger. Any device or system that requires the modification of the grip to accommodate items having more than minimal volume may very well result in that firearm being nonusable and nonmarketable.

SUMMARY

In accordance with the present invention, an electromechanical device for limiting use of a firearm to only authorized user only comprises a power control means, such as a keypad unit for example, that can be accessed only by users possessing the correct code, which, following successful access, allows current from a power source, such as a battery for example, to energize and drive a motor in conjunction with an integrated gear train. The output shaft of the gear train is connected, via a coupler constructed with a threaded output shaft, to a threaded traveling box in which a spring loaded pin is mounted. The spring loaded pin extends into an aperture in the rotatable trigger, preventing said rotatable trigger from rotating and thereby rendering the firearm safe. Upon activation, the motor, gear train, and threaded shaft coupler assembly draws the traveling box away from the rotatable trigger, freeing the pin from the aperture in the rotatable trigger, and allows the firearm to function normally.

OBJECTS AND ADVANTAGES

Accordingly, several objects and advantages of our invention are:

(a) to provide an authorized user safety system for a firearm totally contained on the firearm so as to encourage use by the average firearm owner;

(b) to provide a safety system that is simple to use, can be used in the dark, can lock a loaded firearm, and can be activated in a sufficiently brief time so as not to compromise the utility of the firearm;

(c) to provide an electromechanical safety system that can operate reliably on commonly available inexpensive batteries of sufficiently small size so as to be employed within the firearm without adversely affecting the utility of the firearm.

(d) to provide an electromechanical safety system that can operate reliably using a commercially available motor of sufficiently diminutive size and robustness so as to be employed within the firearm without adversely affecting the utility of the firearm;

(e) to provide a safety system that prevents the operation of the rotatable trigger, hammer, and on a semi-automatic or autoloading firearm, the slide, when the system is in its "locked" mode;

(f) to provide a safety system that can be configured to default in the event of failure, to either a "safe" or "live" mode since the demands of the law enforcement and private citizen communities may differ in that area;

(g) to provide a safety system that would be difficult for an ordinary person to physically defeat, and one that if physically compromised, would potentially disable the firearm. Any such defacement of the firearm may render the firearm much less attractive to a potential buyer;

(h) to provide a safety system accessed by a means personal to the user which can only be reprogrammed by the manufacturer or its authorized agent so as to make the firearm theft resistant.

(I) to provide a safety system that works to lock a firearm whose hammer is either cocked or uncocked, and that will automatically engage itself and lock the firearm after a designated time period.

(j) to provide a safety system that works on firearms without a trigger guard;

(k) to provide a safety system that, in the preferred embodiment, uses a keypad configured with five number buttons, each button representing two sequential numbers, so as to enable the use of any numeric personal authorization code, and where the buttons in the preferred embodiment, are arranged in a "W" configuration so as to enable their employment in a limited space.

(l) to provide a safety system that can be produced commercially at reasonable cost, and that lends itself to adaptation to any firearm with a rotatable trigger.

Further objects and advantages of our invention will become apparent from a consideration of the drawings and ensuing description.

REFERENCE NUMERALS IN DRAWINGS

20 Firearm
22 Keypad Unit
23 Microprocessor
24*a*-24*e* Keypad Number Buttons
26 Battery Indicator
28 Fire or Danger Indicator
30 Safe Indicator
32 Action Button
34 Battery
36 Connecting Wire or Flex Cable
38 Electromechanical Blocking Assembly
40 Motor
42 Gear Train
44 Output Shaft
46 Threaded Shaft Coupler
48 Traveling Box
50 Set Screw
52 Pin Spring
54 Pin
56*a*-56*b* Notches or Apertures
58 Rotatable Trigger
60 Antirotational Device
61 Power Control Means
62 Power Supply Means
63 Blocking Means

DESCRIPTION OF PREFERRED EMBODIMENT

Figure 1:
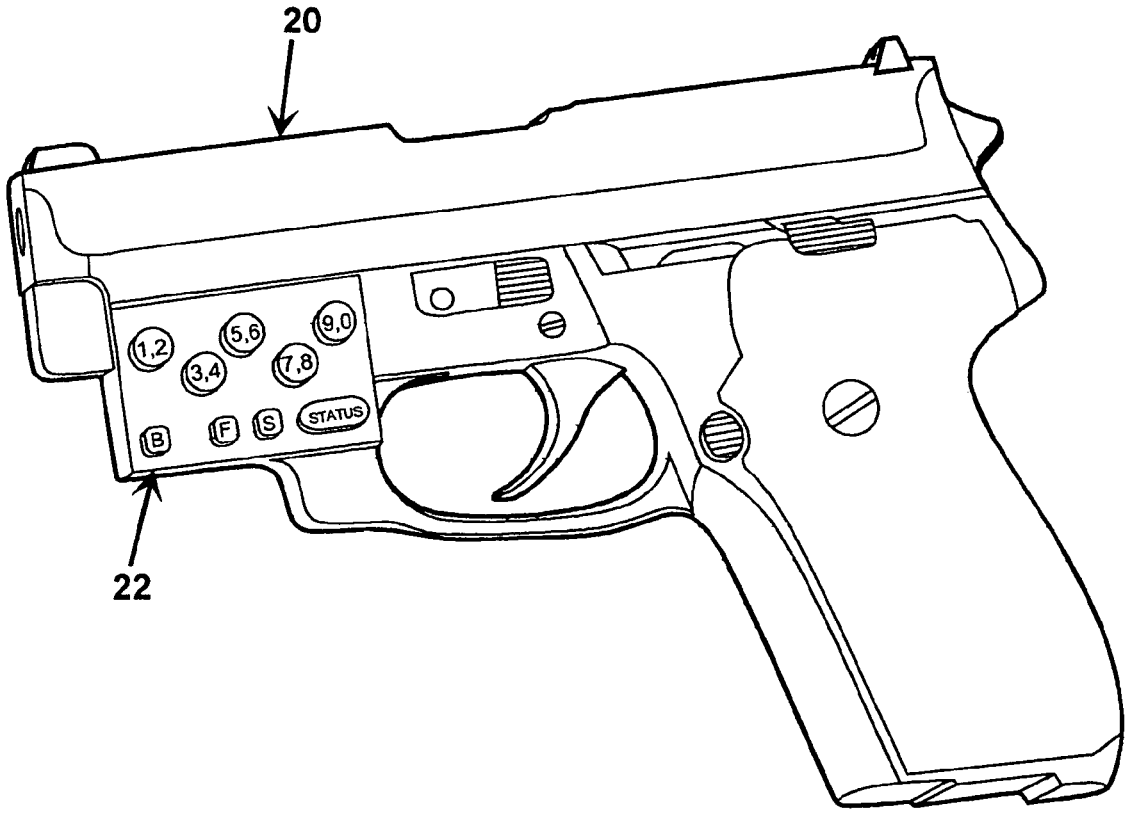
FIG. 1 is a side elevation view of one side of a typical firearm as it would appear with a keypad unit in place.

Referring to FIG. 1, there is shown a firearm having a keypad unit 22 well known in the art, by which the user would enter a personal identification code just as the user would for an ATM machine or for a common electronic lock. (A source of supply for a keypad unit of this type would be Shadowsand Inc., 3735 Palomar Centre, Suite 150-101, Lexington, Ky. 40513 and the unit obtained from Shadowsand, Inc. employed a model PIC 16C74 microprocessor supplied to Shadowsand, Inc. from Microchip Technology, Inc., 2355 w. Chandler Blvd., Chandler, Ariz. 85224.)

The keypad unit 22 has five number buttons 24*a*-24*e* (see FIG. 2), with each of said five number buttons 24*a*-24*e* serving two sequential numbers to allow any numeric personal identification code to be selected. In order to accommodate the five keypad number buttons 24*a*-24*e* (see FIG. 2) in an economical use of the limited space available at the position shown in FIG. 1 for the keypad unit 22, the preferred embodiment has the keypad number buttons 24*a*-24*e* arranged in the shape of a "W". In other embodiments where space would not be limited for placement of said number buttons 24*a*-24*e*, said number buttons 24*a*-24*e* may be spaced in a different alignment.

The keypad unit 22 has a battery indicator 26 (see FIG. 2), which when illuminated, shows that a battery 34 (see FIG. 2) is charged, a fire or danger indicator 28 (see FIG. 2), which when illuminated, shows the firearm 20 (see FIG. 1) to be in an unlocked mode, and a safe indicator 30 (see FIG. 2), which when illuminated, shows the firearm 20 (see FIG. 1) to be in a locked mode. An action button 32 (see FIG. 2) allows the five number buttons 24*a*-24*e* (see FIG. 2), to briefly become active after it is pushed, which in turn allows said number buttons 24*a*-24*e* to be receptive to the entry of the correct personal identification code.

Figure 2:
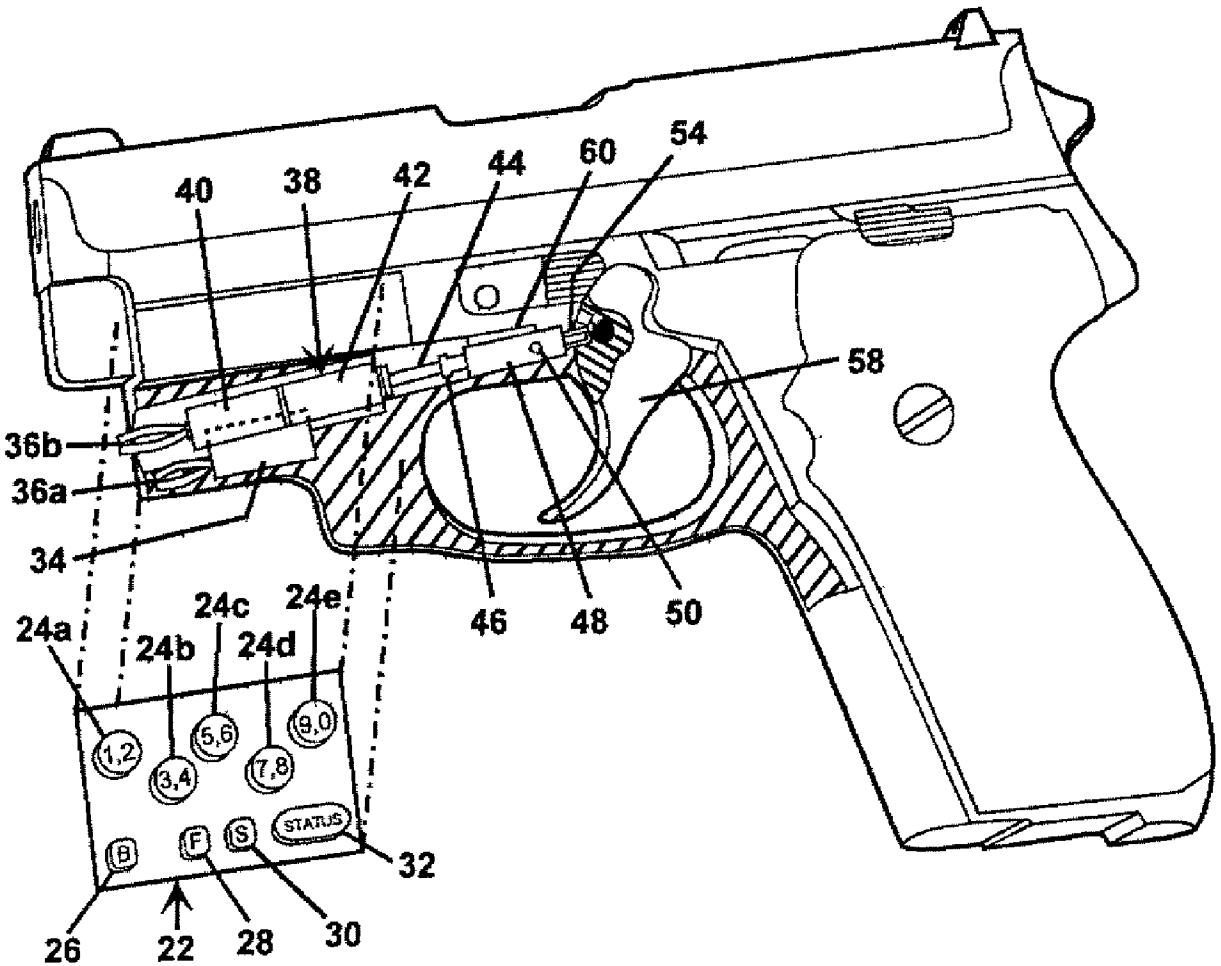
FIG. 2 is a side elevation, view partly in section, of the same side of the firearm of FIG. 1 with the keypad unit removed to show the electrically activated lock apparatus.

The battery 34 (see FIG. 2) is electrically connected to the keypad unit 22 (See FIG. 2) by a wire or flex cable 36*a* (see FIG. 2), and the keypad unit 22 (see FIG. 2) is also electrically connected by a wire or flex cable 36*b* (see FIG. 4) to a motor 40 (see FIG. 2) joined to a gear train 42 (see FIG. 2). An output shaft 44 (see FIG. 4) is connected to a threaded shaft coupler 46 (see FIG. 4), the threaded end of is threaded into a complementary sized threaded channel (not shown) in a traveling box 48. Emerging from said traveling box 48 is a pin 54 (see FIG. 4) extending into one of two notches or apertures 56*a* and 56*b* (see FIG. 5) in a pivoted trigger 58 (FIG. 5). A set screw 50 (see FIG. 4) is used to retain the pin 54 (see FIG. 4) inside the traveling box 48 (see FIG. 4).

FIG. 2 shows the firearm 20 locked in the uncocked position with the pin 48 (see FIG. 4) inside the notch or aperture 54*b* (see FIG. 5) of the pivoted trigger 58 (see FIG. 5). If the firearm 20 (see FIG. 2) were in a cocked mode, the pivoted trigger 58 (see FIG. 5) would have rotated in a counterclockwise direction so that the pin 48 (see FIG. 4) would be seated in the notch or aperture 54*a* (see FIG. 2) to lock the firearm 20 (see FIG. 1).

Figure 3:
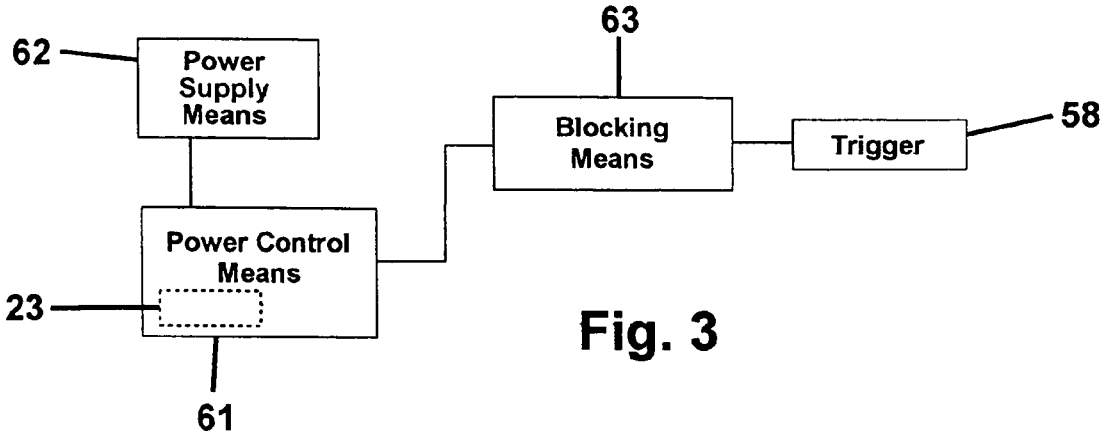
FIG. 3 is a block diagram of the safety mechanism showing the interaction of the power control means with the power supply means, the blocking means, and the trigger.

FIG. 3 is a block diagram showing the sequencing of events in the use of the present invention. A power control means 61, which in the preferred embodiment is the keypad assembly 22 (see FIG. 2), well known in the art, is connected electrically to both the battery 34 (see FIG. 2) and the motor 40 (see FIG. 2). Upon achieving entry access by using the appropriate personal authorization, such as a numeric personal authorization code, the electric current from a power supply means 62 (see FIG. 3) is allowed to energize a blocking means 63 (see FIG. 3) to prevent or allow, as appropriate, the rotational movement of the rotatable trigger 58 (see FIG. 5).

Figure 4:
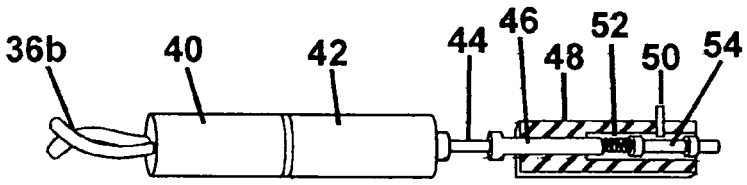
FIG. 4 is a side elevation view, partly in section, of the blocking means.
Figure 5:
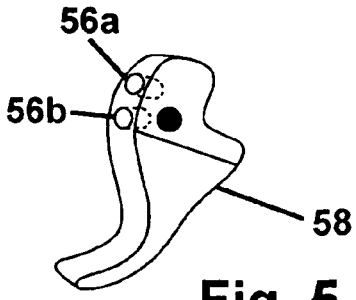
FIG. 5 is a perspective view of the trigger configured to accept the pin of the blocking means.
Figure 6:
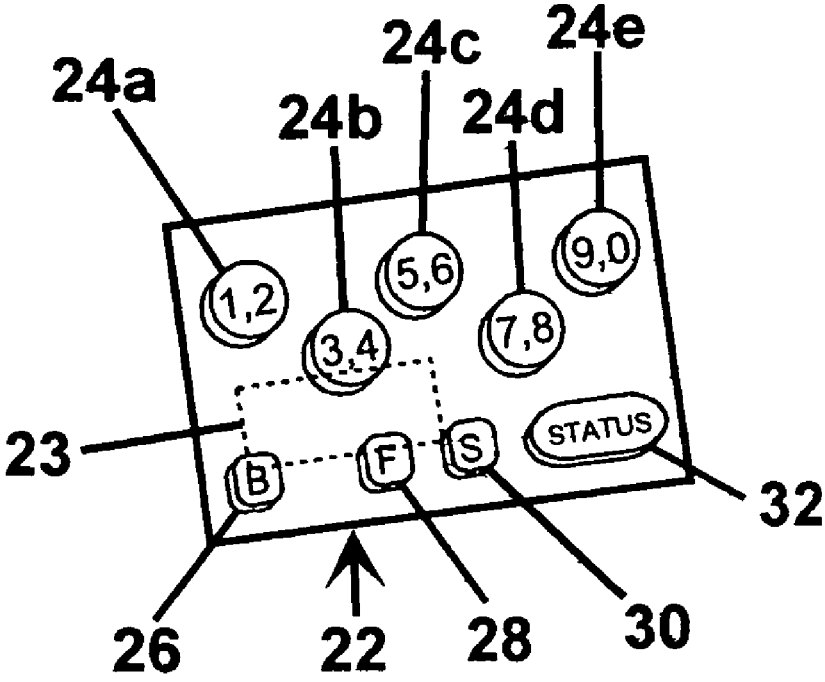
FIG. 6 is a detail view of the keypad employed in the preferred embodiment.

The blocking means 63 (see FIG. 3) includes the motor 40, the gear train 42, the output shaft 44, the threaded shaft coupler 46, the traveling box 48, the spring 52, the pin 54, and the set screw 50 as shown in detail in FIG. 4. The motor 40 (see FIG. 4) drives the gear train 42 (see FIG. 4) which increases torque and rotates the output shaft 44 (see FIG. 4). If the output shaft 44 (see FIG. 4) is of sufficient length and threaded, the threaded shaft coupler 46 (see FIG. 4) would not be needed. However, if output shaft 44 (see FIG. 4) is either not threaded or not of sufficient length, then a threaded shaft coupler 46 (see FIG. 4) featuring an elongated threaded shaft of sufficient length needs to be attached to the output shaft 44 (FIG. 4) to convert the rotary motion of the output shaft 44 (FIG. 4) into axial motion. Once the pin 54 (see FIG. 4) has reached the fully locked or unlocked position, no current is required to hold the motor 40 (see FIG. 4), gear train 42 (see FIG. 4), output shaft 44 (see FIG. 4), threaded shaft coupler 46 (see FIG. 4), traveling box 48 (see FIG. 4) and pin 54 (see FIG. 4) in position. Due to the torque multiplication provided by said gear train 42, and said output shaft 44, internal friction is sufficient to prevent movement.

The output shaft 44 (see FIG. 4), if threaded and long enough, or the threaded shaft coupler 46 (see FIG. 4), if not, is inserted inside a threaded channel (not shown) inside the traveling box 48 (see FIG. 4). As the threaded shaft portion of the threaded shaft coupler 46 (see FIG. 4) turns, the traveling box 48 (see FIG. 4) is pulled backward or is pushed forward in a channel of accommodating dimension (not shown) cut into the frame of the firearm 20 (see FIG. 1), compressing or decompressing a spring 52 (see FIG. 4), located at the end of the pin 54 (see FIG. 4) closest to the gear train 42 (see FIG. 4).

In the locking action, pin 54 (see FIG. 4) is pushed forward by the energy of the spring emerging partially out of the end of the traveling block 48 (see FIG. 4) and seats itself into the notch or aperture 54*a* or 54*b* (see FIG. 5) in the rotatable trigger 58 (see FIG. 5), as appropriate, depending on whether the firearm 20 (see FIG. 1), is in the cocked or uncocked mode. Upon pinning the rotatable trigger 58 (see FIG. 5), the firearm 20 (see FIG. 1) cannot be fired or cocked, or the slide worked backward on a semi-automatic or autoloading firearm. The set screw 50 (see FIG. 4) traps the pin 54 (see FIG. 4) inside the traveling box 48 (see FIG. 4).

A rotatable trigger 58 is shown at FIG. 5 with notches or apertures 56*a* and 56*b* detailed.

Figure 7:
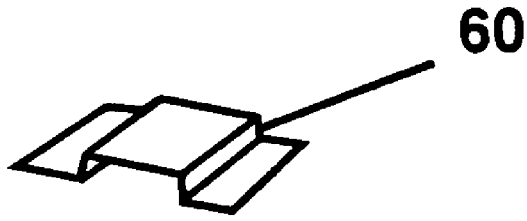
FIG. 7 is a detail view of one embodiment of the optional antirotational device.

FIG. 7 is a representation of one suggested design of an antirotational device 60, the use of which is optional. The traveling box 48 (see FIG. 4) rests in a channel (not shown) cut in the frame of a firearm 20 (see FIG. 1). Depending on the firearm, the top of said channel in which traveling box 48 (see FIG. 4) rests may be open to the inside of the firearm 20 (see FIG. 1). It may be necessary in some applications to fashion a device to inhibit or prevent the traveling box 48 (see FIG. 4) from being rotated or flexed by the shock of the discharge of the cartridge or by the attempted rotation of the trigger. The design of the antirotational device 60 (see FIG. 7) would have to be adapted for each particular model of the firearm 20 (see FIG. 1) but is delineated at FIG. 7 in a generic form to illustrate its function. The antirotational device 60 shown in FIG. 7 would rest over the traveling box 48 (see FIG. 4) with the flanged portion being trapped between the two parts of the firearm 20 (see FIG. 1) above and below said flanged portions, with the contoured center part of the antirotational device 60 (see FIG. 7) directly in contact with and preventing any upward motion by the traveling box 48 (see FIG. 4).

Operation

Assuming the firearm 20 (see FIG. 1) rests in a locked mode with the pin 54 (see FIG. 4) seated inside the notch or aperture 56*a* or 56*b* (see FIG. 5), the firearm 20 (see FIG. 1) is inoperable. The slide on a semi-automatic or autoloading firearm cannot be worked backwards, the trigger cannot rotate, and the hammer cannot be pulled back. In the preferred embodiment, an authorized user with the appropriate personal identification code, enters the code by first pushing the action button 32 (see FIG. 7) on the keypad to activate the number buttons 24*a*-24*e* (see FIG. 7), and then enters the correct code by pushing the appropriate number buttons 24*a*-24*e* (see FIG. 7). (Upon pushing said action button 32 or any of said five number buttons 24*a*-24*e*, the keypad 22 (see FIG. 7) would light up and the battery indicator 26 (see FIG. 7) and the safe indicator 30 (see FIG. 7) would momentarily light up as well, indicating that the battery 34 (see FIG. 2) is charged and the firearm 20 (see FIG. 1) is in a safe mode.)

Upon the correct code being entered, the electric current would flow from the battery 34 (see FIG. 2) to the motor 40 (see FIG. 4) which would drive the gear train 42 (see FIG. 4) to turn output shaft 44 (see FIG. 4) in a rotary direction. The threaded shaft portion of the threaded shaft coupler 46 (see FIG. 4) resting inside a treaded channel in the traveling box 48 (see FIG. 4), would screw itself into the traveling box 48 (see FIG. 4), pulling said traveling box 48 backward. The set screw 50 (see FIG. 4) would contact pin 54 (see FIG. 4) inside the traveling box 48 (see FIG. 4) with the result said pin 54 withdraws from the notch or aperture 56*a* or 56*b* (see FIG. 5), as appropriate, leaving the firearm 20 (see FIG. 1) in a position to work normally.

Accordingly, the electromechanical locking mechanism of this invention can be used to effectively render a firearm inoperable, whether loaded or unloaded, whether cocked or uncocked, while restricting the use of that firearm to only authorized users. Additionally, this firearm should be commercially feasible since the parts used, including the batteries, are commonly available, and can be adapted to virtually any firearm having a rotatable trigger at reasonable cost. A firearm with this system installed may make the firearm "theft resistant" since the system would be integral to the firearm and could not easily be physically compromised by an average person using common tools without significantly defacing the appearance. This firearm should also be marketable since the firearm could be activated easily in the dark with a speed quick enough that the utility of the firearm would not be adversely affected. Additionally, the use of a motor allows an ordinary expendable batteries to be used which have a much longer shelf life than a rechargeable batteries.

Although the description above contains many specificities, these should not be construed as limiting the scope of the invention but as merely providing illustrations of some of the presently preferred embodiments of this invention. For example, the trigger need not be notched but may be modified by the addition of a lug beneath which the pin would be inserted; the threaded shaft coupler may be dispensed with if the output shaft of the gear train were threaded and of sufficient length to be able to move the traveling box axially; the keypad could be replaced by a biometric identity device such as a fingerprint reader.

Thus the scope of the invention should be determined by the appended claims and their legal equivalents rather than by the examples given.

We claim:

1. A pistol having a locking mechanism configured to lock a trigger mechanism of the pistol if an attempt is made by an unauthorized person to fire the pistol, the locking mechanism comprising:

an identification unit configured to detect an identification signal inputted into the identification unit;

a control unit connected to the identification unit, the control unit configured to compare the signal inputted into the identification unit with a stored identification code;

an actuator device including a geared motor connected to the control unit and connected by a threaded spindle and nut connection with a mechanical locking element which is movable between a locked position and an unlocked position, wherein in the locked position the locking element locks a trigger tongue of the pistol;

a battery for supplying electrical power to the locking mechanism; and a plurality of display elements configured to display an operating status of the locking mechanism.

2. A pistol as claimed in claim 1, wherein the locking element is configured to engage a notch in the trigger tongue, and wherein the locking element is guided for movement in a bolt and is spring-loaded.

3. The pistol as claimed in claim 1, wherein at least the greater portion of the locking mechanism is located in front of a trigger guard and below the barrel of the pistol.

4. The pistol as claimed in claim 1, wherein the identification unit comprises a keypad for the input of the code.

5. The pistol as claimed in claim 1, wherein the identification unit comprises a finger-print scanner.

* * * * *